US005469585A

United States Patent [19]

Shiue

[11] Patent Number: 5,469,585

[45] Date of Patent: Nov. 28, 1995

[54] FLUSHING DEVICE OF TOILET

[76] Inventor: Yaw-Ching Shiue, 1F, 125-6, Sec. 1, San Min Rd., Taichung, Taiwan

[21] Appl. No.: 304,124

[22] Filed: Sep. 12, 1994

[51] Int. Cl.[6] ..... E03D 1/14

[52] U.S. Cl. ..... 4/326

[58] Field of Search ..... 4/326, 327, 405, 4/411–414

[56] References Cited

U.S. PATENT DOCUMENTS

| | | | |
|---|---|---|---|
| 4,141,092 | 2/1979 | Jones | 4/413 X |
| 5,033,129 | 7/1991 | Gajewski | 4/326 |
| 5,381,561 | 1/1995 | Carson | 4/326 |
| 5,400,445 | 3/1995 | Hull | 4/325 |

*Primary Examiner*—Charles E. Phillips

[57] ABSTRACT

A toilet flushing device comprises a water tank provided therein with an inlet tube, a float arm, an overflow tube, a first outlet tube, and a second outlet tube which is shorter than the first outlet tube. The first and the second outlet tubes are provided movably and respectively at the top end thereof with a cap which is controlled by a flushing mechanism mounted in the water tank. The flushing mechanism is made up of a control member having a shaft to which a rear control rod, a front control rod and a locating tube are fastened. The rear control rod is fastened with a first flush lever located outside the water tank. The locating tube is made integrally with the front control rod and is meshed with a second flush lever located outside the water tank.

2 Claims, 5 Drawing Sheets

FLUSHING DEVICE OF TOILET

FIELD OF THE INVENTION

The present invention relates generally to a toilet flushing device, and more particularly to a toilet flushing device capable of flushing in an interrupted manner.

BACKGROUND OF THE INVENTION

The toilet flushing device of the prior art permits a full tank of water to be emptied out in one flush for cleaning the toilet bowl even at such time when there is only a small amount of human waste in the toilet bowl. In other words, the toilet flushing device of the prior art is of a little help to the water conservation. As a result, a new toilet was developed and introduced. Such a new toilet is provided with a water tank having two water outlets located at different levels so as to permit a less than full tank of water to be emptied out. However, such a new toilet as described above is limited in that it is rather complicated in construction, and that it is not compatible with the conventional toilet.

SUMMARY OF THE INVENTION

It is therefore the primary objective of the present invention to provide a toilet with a flushing means capable of flushing in an interrupted manner so as to conserve the water.

It is another objective of the present invention to provide a toilet flushing device which is simple in construction and is therefore compatible with the conventional toilet water tank.

In keeping with the principle of the present invention, the foregoing objectives of the present invention are attained by toilet flushing device, which comprises a water tank provided therein with an inlet tube, a float arm fastened to the top of the inlet tube, an overflow tube, a first outlet tube, and a second outlet tube having a top end located at a lower level than a top end of the first outlet tube. The first and the second outlet tubes are provided movably and respectively at the top end thereof with a cap which can be controlled by a flushing device mounted in the water tank. The flushing device comprises a control member having a shaft to which a rear control rod, a front control rod and a locating tube are Fastened. The rear and the front control rods are used to control the flushs via the first and the second outlet tubes. The rear control rod is fastened with a first flush lever located outside the water tank. The locating tube which is made integrally with the front control rod is meshed with a second flush lever located outside the water tank.

DETAILED DESCRIPTION OF THE INVENTION

Figure 1:
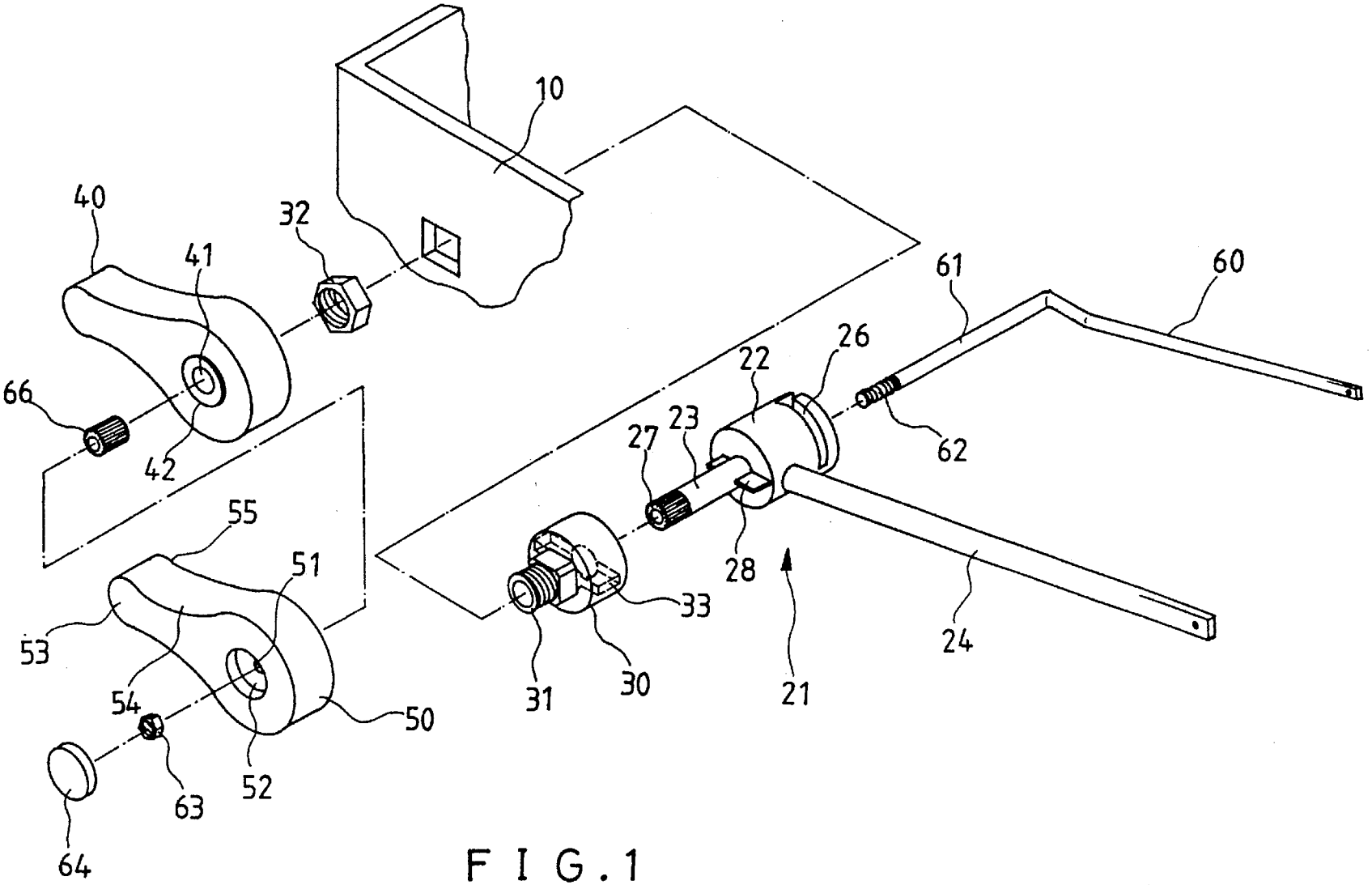
FIG. 1 shows an exploded view of a toilet flushing device of the present invention.
Figure 2:
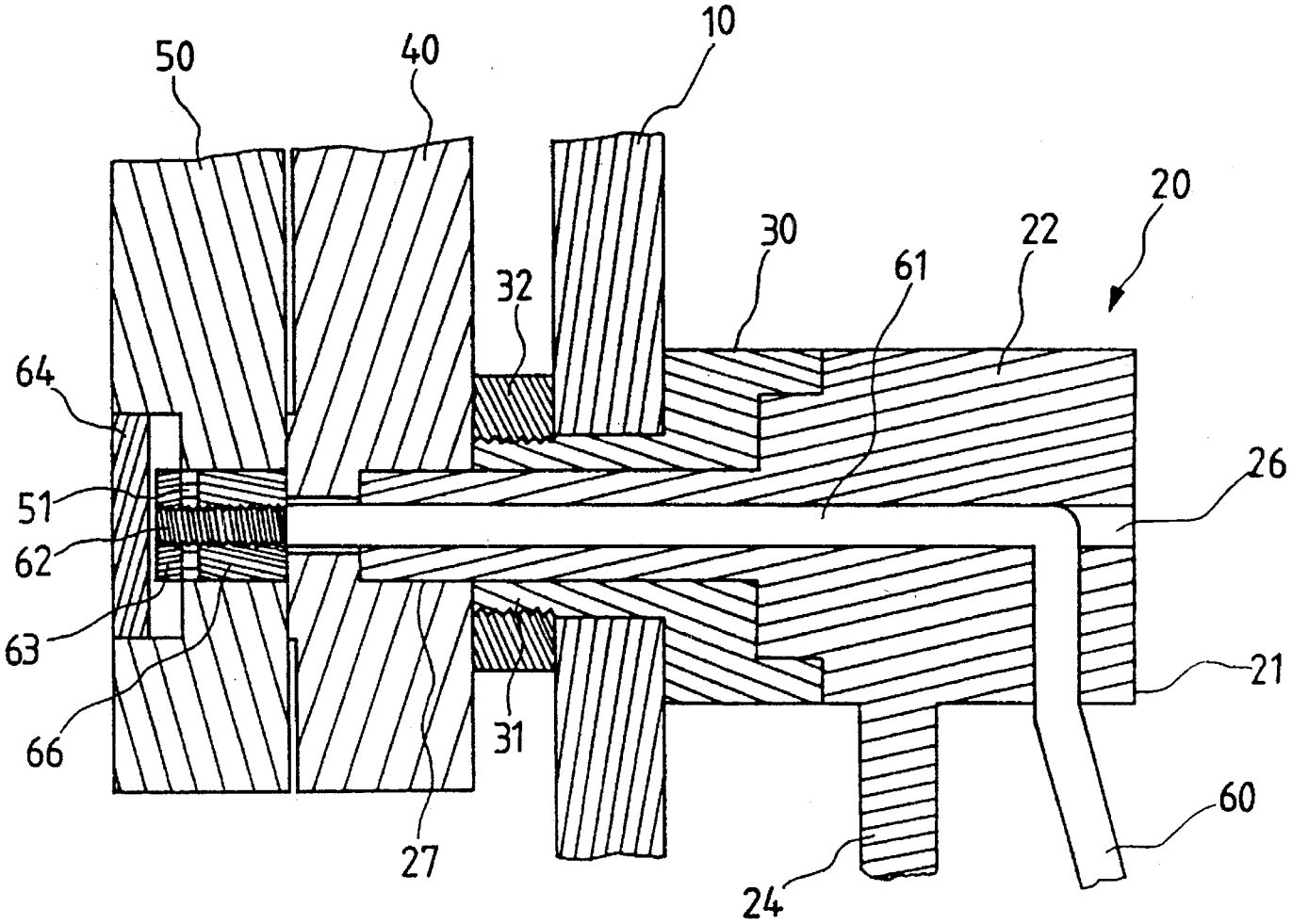
FIG. 2 shows a sectional view of the toilet flushing device in combination according to the present invention.
Figure 3:
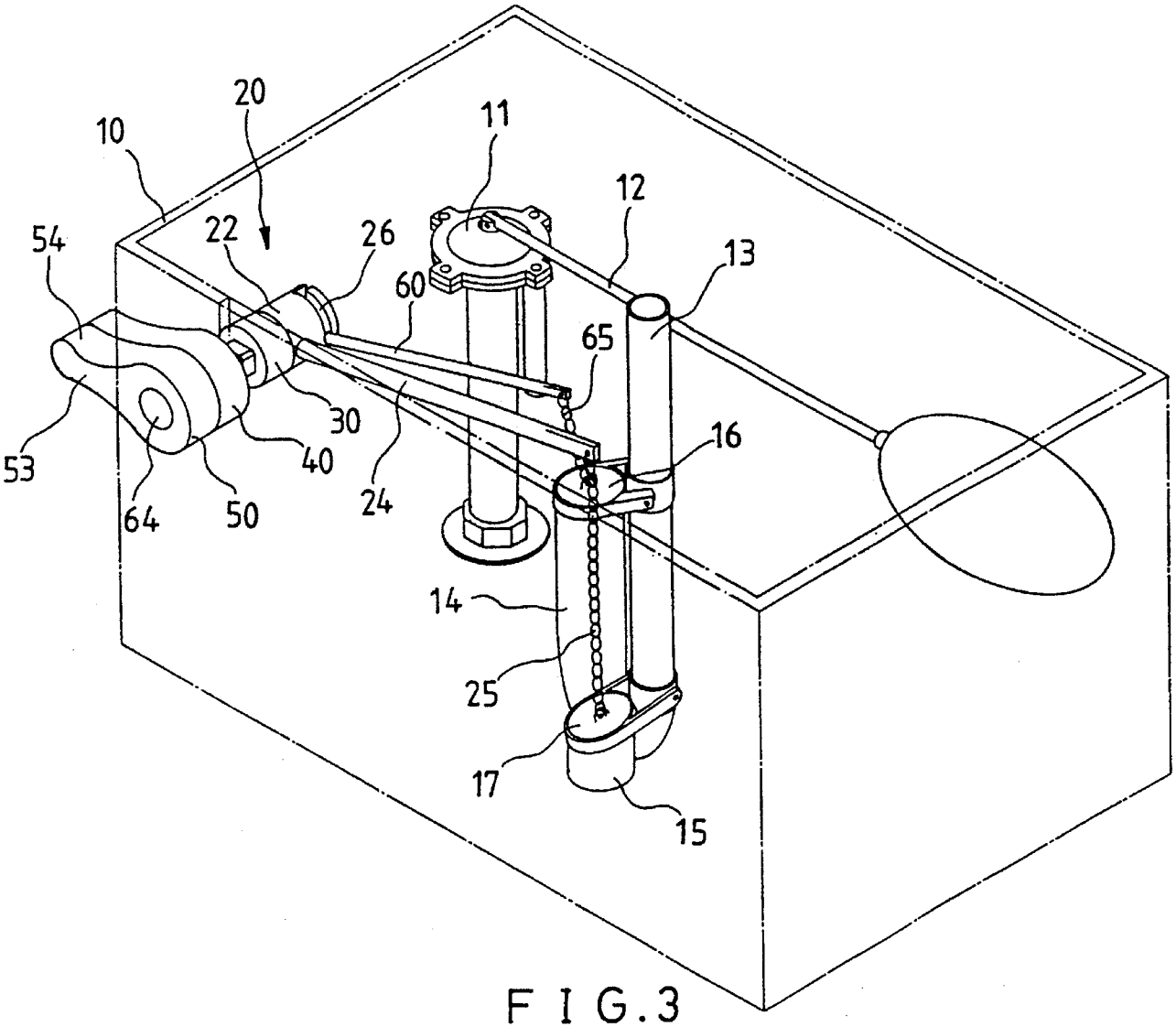
FIG. 3 shows a perspective view of the toilet flushing device of the present invention.

As shown in FIGS. 1, 2 and 3, a toilet flushing device of the present invention includes a water tank 10 in which an inlet tube 11, a float arm 12 fastened at one end thereof to top end of the inlet tube 11, an overflow tube 13, a first outlet tube 14 and a second outlet tube 15 are disposed. The first and the second outlet tubes 14 and 15 are provided respectively and movably at the top end thereof with caps 16 and 17. The first and the second outlet tubes 14 and 15 are different in height, with the first outlet tube 14 being taller than the second outlet tube 15. The closing and the opening of the caps 16 and 17 of the first outlet tube 14 and the second outlet tube 15 are controlled by a flushing apparatus 20 which is mounted in the water tank 10.

The flushing apparatus 20 comprises the component parts which are described hereinafter.

A control member 21 comprises a shaft 22 to which a locating tube 23 and a front control rod 24 ape fastened. The front control rod 24 has a free end which is located over the top end of the second outlet tube 15 and is connected with the cap 17 via a chain 25. As a result, the cap 17 can be lifted so as to permit the water in the water tank 10 to flow into the second outlet tube 15. The shaft 22 is provided in the top surface thereof with an L-shaped slot 26 in communication with the locating tube 23. Located at the free end of the locating tube 23 is a threaded portion 27. The locating tube 23 is further provided with two projections 28 located at the junction between the shaft 22 and the locating tube 23.

A locating sleeve 30 is disposed in the water tank 10 such that the threaded outer end 31 thereof is located outside the water tank 10 via a through hole of the water tank wall. The locating tube 23 is fitted into the locating sleeve 30 such that the two projections 28 of the locating tube 23 are received in two position-limiting slots 33 of the locating sleeve 30. The control member 21 can be therefore held securely in place in the water tank 10 by a fastening nut 32 engageable with the threaded outer end 31 of the locating sleeve 30, as shown in FIG. 1.

A second flush lever 40 is provided with a threaded through hole 41 engageable with the threaded portion 27 of the locating tube 23. The second flush lever 40 is further provided with a Flange 42 located at the outer end of the threaded through hole 41.

A first flush lever 50 is provided with a threaded through hole 51, a circular slot 52 located at the outer end of the threaded through hole 51, a press portion 53 located at one end thereof, an arcuate surface 54 extending inwards from the press portion 53, and a raised surface 55 located between the press portion 53 and the arcuate surface 54.

A rear control rod 60 of a curve construction has an outer segment 61 with a threaded end 62. The outer segment 61 of the rear control rod 60 is received in the L-shaped slot 26 of the shaft 22, the locating tube 23, the locating sleeve 30 and the threaded through hole 41 of the second flush lever 40 such that the threaded end 62 of the outer segment 61 is fastened with a bushing 66 having a threaded outer surface engageable with the threaded through hole 51 of the first flush lever 50, and that the threaded end 62 of the outer segment 61 is located in the circular slot 52 of the first flush lever 50, and further that, the threaded end 62 of the outer segment 61 is fastened securely with a fastening nut 63, as shown in FIG. 1. The fastening nut 63 is covered with a cover 64 which is dimensioned to fit into the circular slot 52 of the first flush lever 50. The rear control rod 60 has an inner segment with a free end which is located over the top end of the first outlet tube 14 and is fastened with the cap 16 of the first outlet tube 14 via a chain 65.

Figure 4:
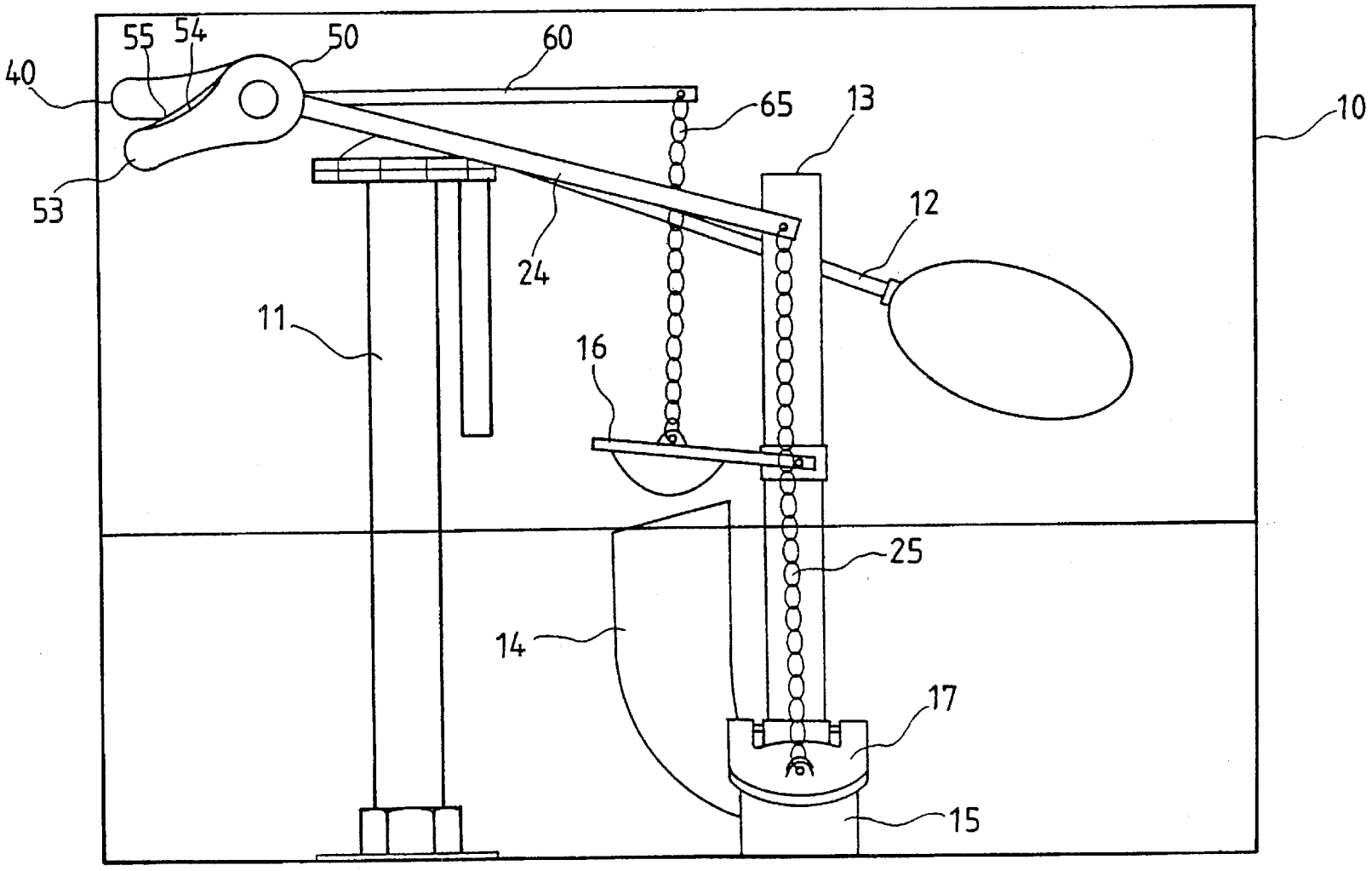
FIG. 4 is a schematic view of the present invention at work, showing that a small amount of water is flushed.

As illustrated in FIGS. 2 and 4, when the first flush lever 50 is pressed, the threaded through hole 51 of the first flush lever 50 is caused to mesh with the bushing 66 to which the threaded end 62 of the outer segment 61 of the rear control rod 60 is fastened, thereby causing the rear control rod 60 to rise lift the cap 16 of the first outlet tube 14 so as to permit only a small amount of the tank water to flow into the first outlet tube 14 for washing the toilet bowl in which there is a small amount of human waste. It must be noted here that the rear control rod 60 can be actuated to rise without difficulty in view of the fact that the direction in which the threaded end 62 of the outer segment 61 of the rear control rod 60 engages the bushing 66 is opposite to the direction in which the first flush lever 50 is pressed. In addition, the arcuate surface 54 and the raised surface 55 of the first flush lever 50 serve to prevent a person's finger from sliding accidentally toward the second flush lever 40 at the time when the finger is pressing the first flush lever 50.

Figure 5:
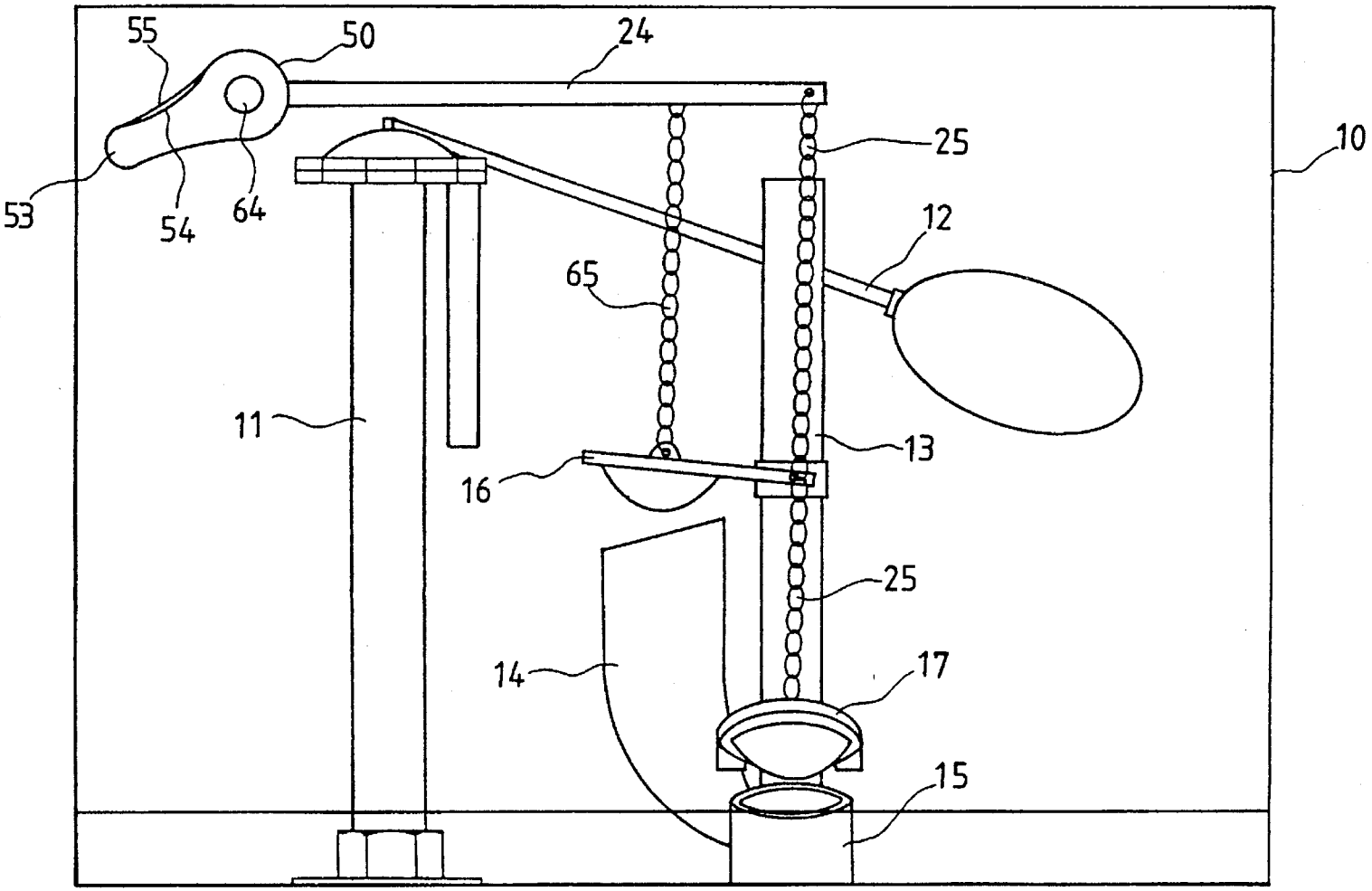
FIG. 5 is another schematic view of the present invention in action, showing that a greater amount of water is flushed.

As illustrated in FIGS. 2 and 5, then the second flush lever 40 is pressed, the entire control member 21 is actuated to rise in view of the fact that the threaded through hole 41 of the second flush lever 40 is caused to engage the threaded portion 27 of the locating tube 23. As mentioned previously, the locating tube 23 and the front control rod 24 of the control member 21 are made integrally. The outer segment 61 of the rear control rod 60 is received in the L-shaped slot 26 of the shaft 22. As a result, when the second flush lever 40 is pressed, both the front control rod 24 and the rear control rod 60 are actuated to rise simultaneously so that both caps 16 and 17 of the first and the second outlet tubes 14 and 15 are so raised as to permit the tank water of the toilet to flow into the first and the second outlet tubes 14 and 15 for washing the toilet bowl in which there is a relatively large amount of human waste.

The locations of the first and the second outlet tubes 14 and 15 can be rearranged in various ways in conjunction with the lengths of the shaft 22 of the control member 21.

The embodiment of the present invention described above is to be regarded in all respects as merely illustrative and not restrictive. Accordingly, the present invention may be embodied in other specific forms without deviating from the spirit thereof.

The present invention is therefore to be limited only by the scope of the following appended claims,

What is claimed is:

1. A toilet flushing device comprising a water tank provided therein with a inlet tube, a float arm fastened at one end thereof with a top end of said inlet tube, an overflow tube, a first outlet tube having a predetermined height and a cap which is movably attached to a top end thereof, a second outlet tube having a predetermined height and a cap which is movably attached to a top end thereof, and a flushing mechanism;

wherein said flushing mechanism comprises:

a control member provided with a shaft to which a locating tube and a front control rod are fastened, said front control rod having a free end which is located over said top end of said second outlet tube and is fastened with said cap of said second outlet tube via a chain, said shaft provided in a top surface thereof with an L-shaped slot in communication with a hollow interior of said locating tube, said locating tube being provided with a threaded portion on a free end thereof, said locating tube further provided with two projections located at a junction between said shaft and said locating tube;

a locating sleeve disposed in said water tank such that a threaded outer end of said locating sleeve is located outside said water tank via a through hole of said water tank, said locating tube being fitted into said locating sleeve such that said two projections of said locating tube are received in two position-limiting slots of said locating sleeve, said control member being held securely in place in said water tank by a fastening means engageable with said threaded outer end of said locating sleeve;

a first flush lever provided with a threaded through hole, a circular slot located at an outer end of said threaded through hole, a press portion located at one end thereof, an arcuate surface extending inwards from said press portion, and a raised surface located between said press portion and said arcuate surface;

a second flush lever provided with a threaded through hole engageable with said threaded portion of said locating tube, said second flush lever further provided with a flange located at an outer end of said threaded thorough hole; and a rear control rod of a curved construction and having an outer segment provided with a threaded end and received in said L-shaped slot of said shaft, said hollow interior of said locating tube, said locating sleeve and said threaded through hole of said second flush lever such that said threaded end of said outer segment is fitted into a hushing which has a threaded outer surface engageable with said threaded through hole of said first flush lever, and that said threaded end of said outer segment is located in said circular slot of said first flush lever, and further that said threaded end of said outer segment is fastened securely with a fastening means which is covered with a cover dimensioned to fit into said circular slot of said first flush lever, said rear control rod further having an inner segment with a free end which is located over said top end if said first outlet tube and is fastened with said cap of said first outlet tube via a chain.

2. The toilet flushing device according to claim 1 wherein shaft of said control member may be of various lengths for facilitating various arrangements of said first outlet tube and said second outlet tube; and wherein said L-shaped slot of said shaft of said control member may be of various lengths for facilitating various changes in relative combination positions of said front control rod and said rear control rod.

* * * * *